US005331771A

United States Patent [19]

Coushman

[11] Patent Number: 5,331,771

[45] Date of Patent: Jul. 26, 1994

[54] SHARPENING TOOL FOR POINTED OBJECTS

[76] Inventor: Francis D. Coushman, 3104 Springdale Ave., Wausau, Wis. 54401

[21] Appl. No.: 47,044

[22] Filed: Apr. 6, 1993

[51] Int. Cl.[5] ..... B24B 23/02

[52] U.S. Cl. ..... 51/170 R; 51/204

[58] Field of Search ..... 51/204, 206 R, 170 R, 51/181 NT, 170 PT, 73, 102, 208, 209, 210

[56] References Cited

U.S. PATENT DOCUMENTS 201,115 3/1878 Lombard ..... 51/204
2,344,036 3/1944 Frank ..... 51/204
3,722,146 3/1973 Rodriquez et al. ..... 51/170 R
4,866,810 9/1989 Kudlacek ..... 51/170 R

*Primary Examiner*—Roscoe V. Parker
*Attorney, Agent, or Firm*—Tipton L. Randall

[57] ABSTRACT

A sharpening tool for pointed objects is described. The device is comprised of a cylindrical body with a hole extending part way through it from one end. A slot from the side of the cylindrical body intersects the hole near its bottom. A replaceable sharpening stone fits into the slot and is held in place by a retaining means. A shaft is attached to the end of the cylindrical member opposite the hole for attachment to a power source for rotating the device. An object to be sharpened is inserted into the hole and the device is rotated to sharpen the object.

15 Claims, 7 Drawing Sheets

SHARPENING TOOL FOR POINTED OBJECTS

FIELD OF THE INVENTION

This invention relates to an apparatus for sharpening pointed objects and more particularly to a device containing a removable abrasive member which abrades and sharpens pointed objects.

BACKGROUND OF THE INVENTION

There are a number of situations where a pointed object becomes dulled or blunted during use. A common method of resharpening the dulled point is to contact it with an abrasive wheel or grinding stone. The wheel rotates and the object to be sharpened is held against the wheel at a desired angle and rotated to resharpen the point.

In may be undesirable, inconvenient or even impractical to bring some pointed objects to a wheel for grinding. Such a situation is encountered, for instance, for a snowmobile track containing a great number of pointed metal studs which improve traction. The studs become dulled or blunted during use and can be removed for sharpening, but this is difficult and time consuming.

Applicant has invented a device for sharpening such dulled studs in place which provides controlled sharpening in an extremely short time period per stud. The sharpener has a removable abrasive member held at a preselected angle to the stud to be sharpened, providing a consistent finished product. The apparatus is useful for sharpening nearly any pointed object and is not limited to the studs of a snowmobile track.

SUMMARY OF THE INVENTION

The invention comprises an apparatus for sharpening pointed objects. The device comprises a cylindrical member with first and second ends and cylindrical lateral surface, said cylindrical member containing a round aperture of selected diameter, centered on the longitudinal axis of the cylindrical member. The aperture extends from the first end and ends short of the second end, producing a closed end therein. The cylindrical member also contains a slot extending from the cylindrical lateral surface and intersecting a portion of the aperture near the closed end at a selected angle. An abrasive member is positioned within the slot and extends into the aperture near the closed end. An adjustable retaining means is present for retaining the abrasive member in the slot and in contact with an end of a pointed object inserted within the aperture. There is also a means extending from the second end of the cylindrical member along the longitudinal axis thereof, for attachment of a power source for rotating the apparatus.

DESCRIPTION OF THE PREFERRED EMBODIMENTS

Figure 1:
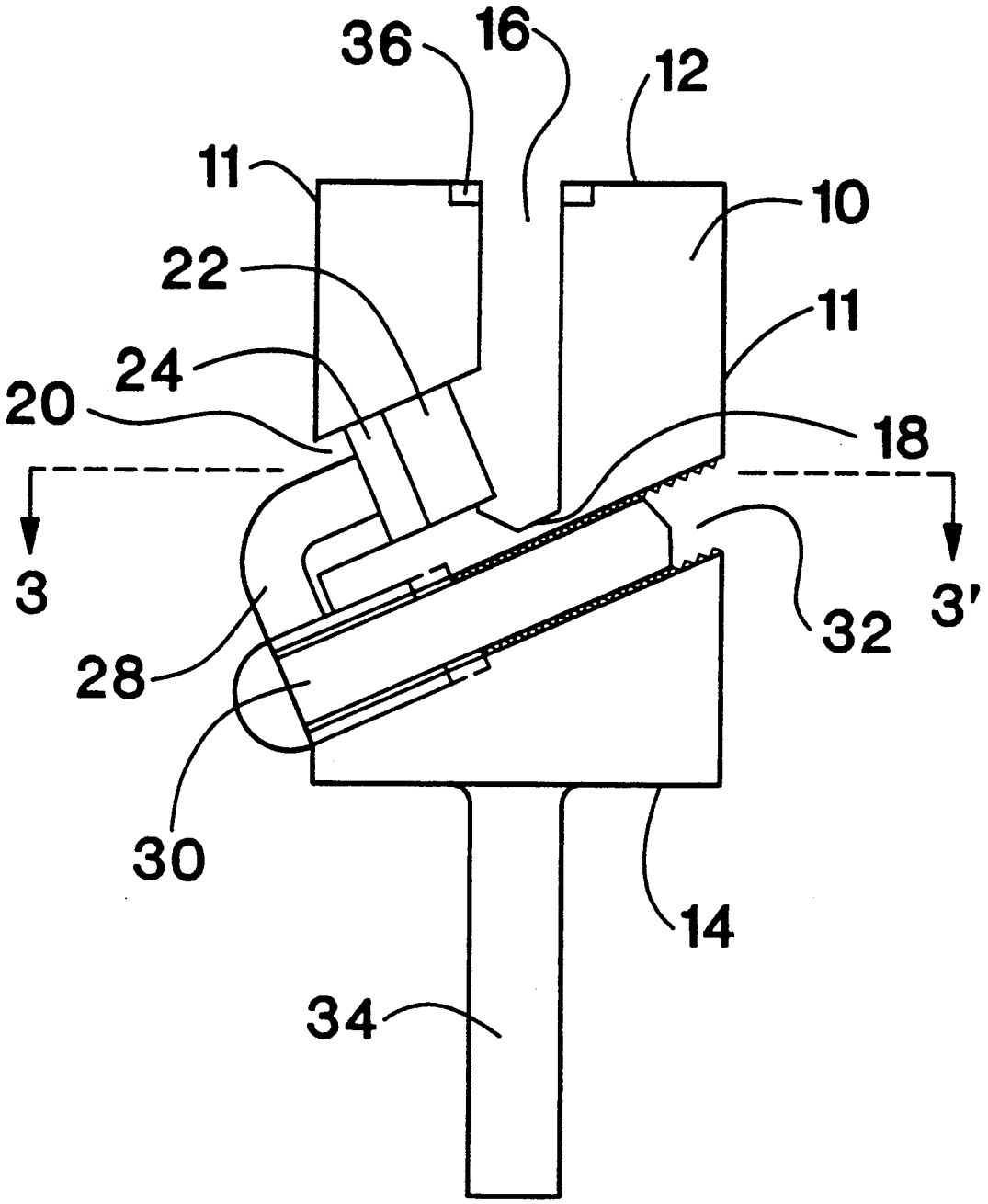
FIG. 1 is a vertical sectional view of one embodiment of the sharpening apparatus invention.

Referring to FIG. 1, the apparatus comprises a cylindrical member 10 with a cylindrical lateral surface 11, a first end 12 and a second end 14. Within the cylindrical member 10 is an aperture 16 which extends from the first end 12 toward the second end 14, but ends short of the second end, producing a closed end 18. The aperture has a selected diameter and is centered on the longitudinal axis of the cylindrical member 10.

Figure 2:
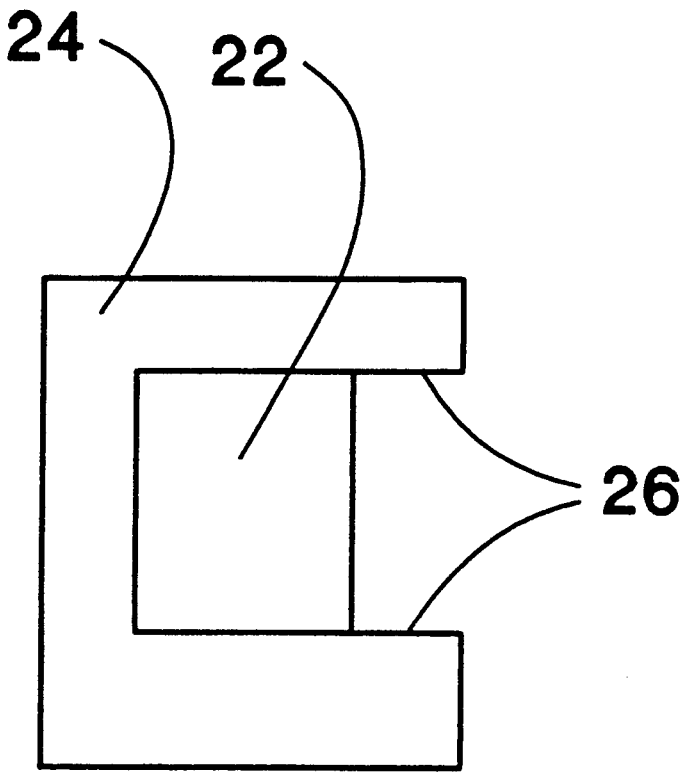
FIG. 2 is a plan view of a holder with sharpening stone in place for use with the embodiment of FIG. 1..
Figure 3:
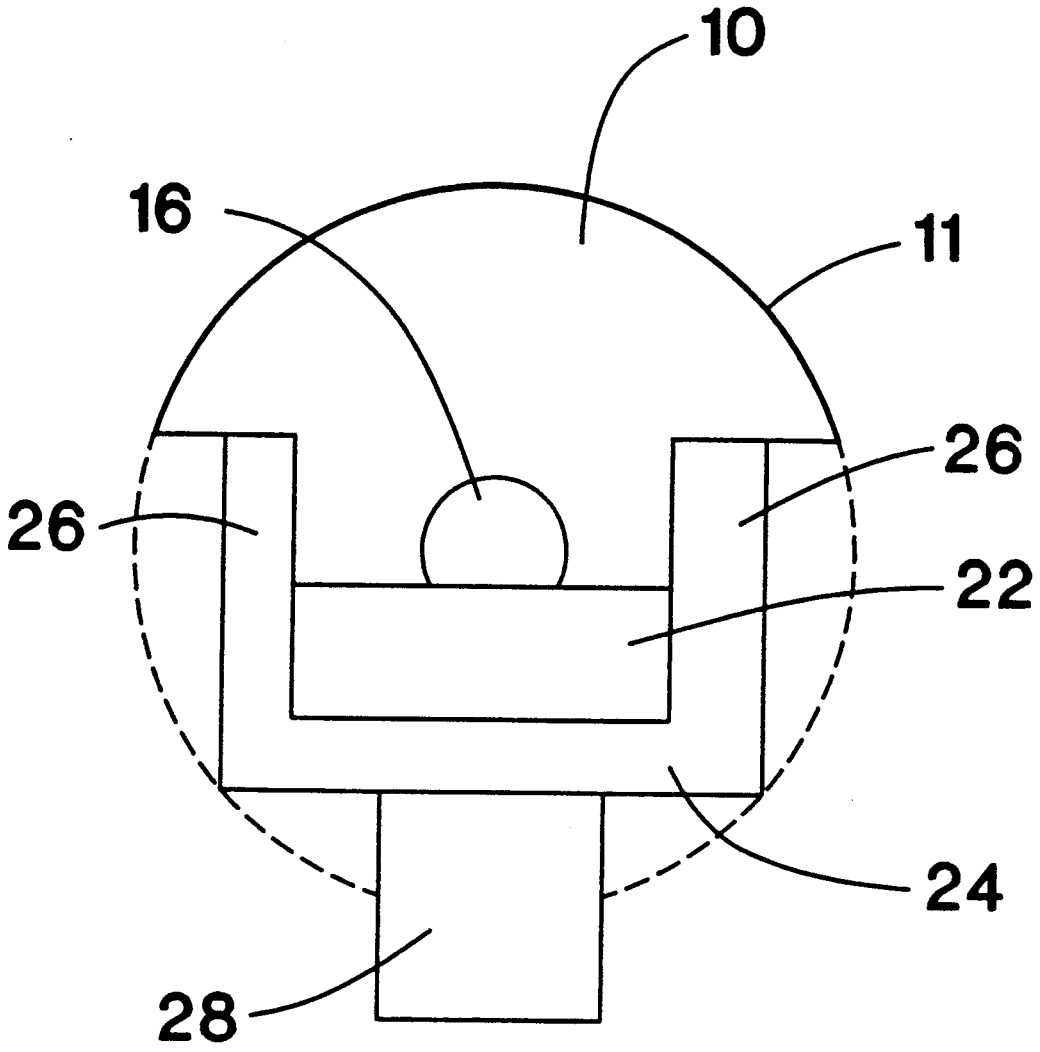
FIG. 3 is a horizontal sectional view along the line 3—3′ of FIG. 1.

The cylindrical member 10 also contains a slot 20 which extends from the lateral surface 11 and intersects only a part of the aperture near the closed end 18, at a selected angle to the aperture 16. The angle may be a right angle or an oblique angle as shown in FIG. 1. Near the outer edges of the cylindrical member, the slot extends beyond the intersection of the slot and aperture. A generally rectangular abrasive member 22, such as a sharpening stone or similar material, fits into the slot and extends into the aperture 16 near the closed end 18. A generally U-shaped holder 24, holds the abrasive member 22 or stone in position in the slot. The U-shaped holder 24 with abrasive member 22 in position is shown in plan view in FIG. 2. The leg ends 26 of the holder 24 extend beyond the aperture in the slot 20, securely positioning the stone in the side of the aperture at the angle of the slot 20. A cross sectional view of the device along the line 3—3′ of FIG. 1 is shown in FIG. 3 which provides the orientation of the stone 22, the holder 24, the slot 20 and the aperture 16.

The abrasive stone and holder are retained in position by an adjustable retaining means comprising a lever member 28 with a retaining screw 30. The lever member 28 and screw 30 are secured within a threaded aperture 32 which extends into the main body of the cylindrical member be at a point below the aperture bottom 18. Turning the retaining screw 28 into the threaded aperture 32 brings the lever member 28 into contact with the holder 24 which maintains the stone 22 in place. The lever member and screw combination is well known in the art and commercially available.

A shaft 34 is connected at one end to the second end of the cylindrical member 10 along the longitudinal axis. The shaft 34 provides a means of attaching a power source, such as an electric drill, pneumatic die grinder or the like, for rotating the whole sharpening device. An optional bushing 36 surrounds the aperture 16 at the top 12 of the cylindrical member 10. The bushing 36 provides a means of maintaining the selected diameter of the aperture 10 by replacing the bushing as wear occurs. Also, a bushing with an internal diameter smaller than the diameter of the aperture 16 may be employed for use with smaller diameter objects.

A pointed object to be sharpened is inserted into the aperture 16 and the end of the object contacts the abrasive member 22. The whole sharpening device is rotated around the longitudinal axes by a drill connected to the shaft 34. As the abrasive stone 22 rotates, it removes materials such as burs or the like from the end of the object inserted. The stone may be composed of silicon carbide, aluminum oxide or diamond imbedded material, which is commercially available in square stock that can be cut to size to fit into the device. As the stone wears away, it is turned 90 degrees in the slot 20 by releasing the retaining means and then reassembling the device. Also, by offsetting the legs 26, where one leg is made thicker than the other, the stone 22 may be turned 180 degrees with the same face in the slot. The offset changes the point of contact for that face of the stone, thus providing a total of eight grinding surfaces from just one stone. Should the stone wear out or crack, it is easily replaced by loosening the retaining means and inserting a replacement stone in the slot. The device can be constructed to handle various sized objects by using apertures of various diameters or by employing various size bushings to hold the object to be sharpened.

Figure 4:
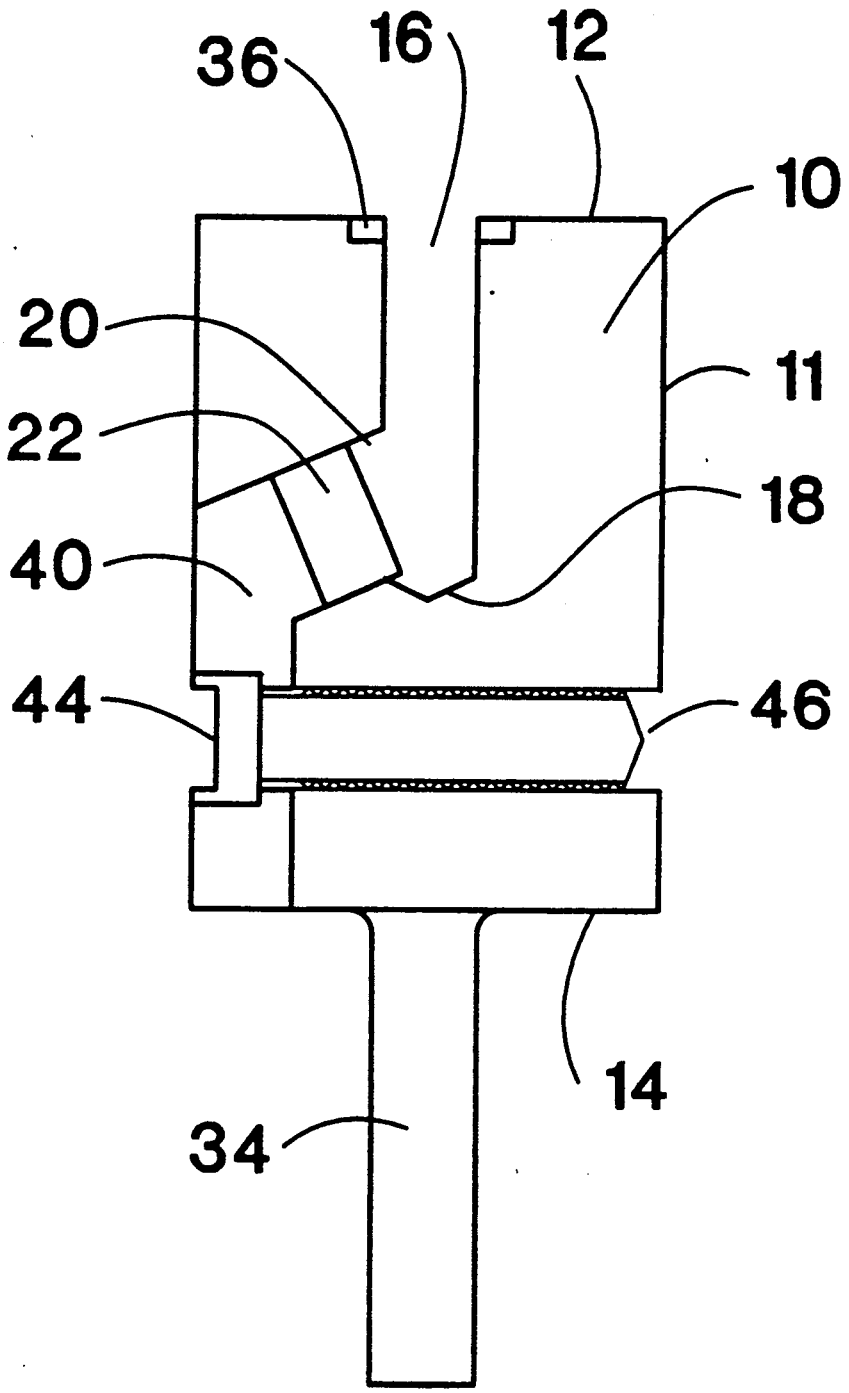
FIG. 4 is a vertical sectional view of another embodiment of the sharpening apparatus invention.

FIG. 4 shows another embodiment of the instant invention. Those components common to FIGS. 1 and 4 are denoted by the same indica.

Referring to FIG. 4, The apparatus comprises a cylindrical member 10 with a cylindrical lateral surface 11, a first end 12 and a second end 14. Within the cylindrical member 10 is an aperture 16 which extends from the first end 12 toward the second end 14, but ends short of the second end, producing a closed end 18. The aperture has a selected diameter and is centered on the longitudinal axis of the cylindrical member 10.

The cylindrical member 10 also contains a slot 20 which extends from the lateral surface 11, and intersects a part the aperture near the closed end 18, at a selected angle to the aperture 16. The angle may be a right angle or an oblique angle as shown in FIG. 4. Near the outer edges of the cylindrical member, the slot extends beyond the intersection of the slot and aperture. A generally rectangular abrasive member 22, such as a sharpening stone or similar material, fits into the slot and extends into the aperture 16 near the closed end 18. A hemispherical cross section portion of the cylindrical member 10 is removed, this portion extending from the second end 14 and intersecting the slot 20. The flat bottom of the portion is located about half way between the outer cylindrical lateral surface 11 and the longitudinal axis of the cylindrical member 10 as shown in FIG. 4.

Figure 5:
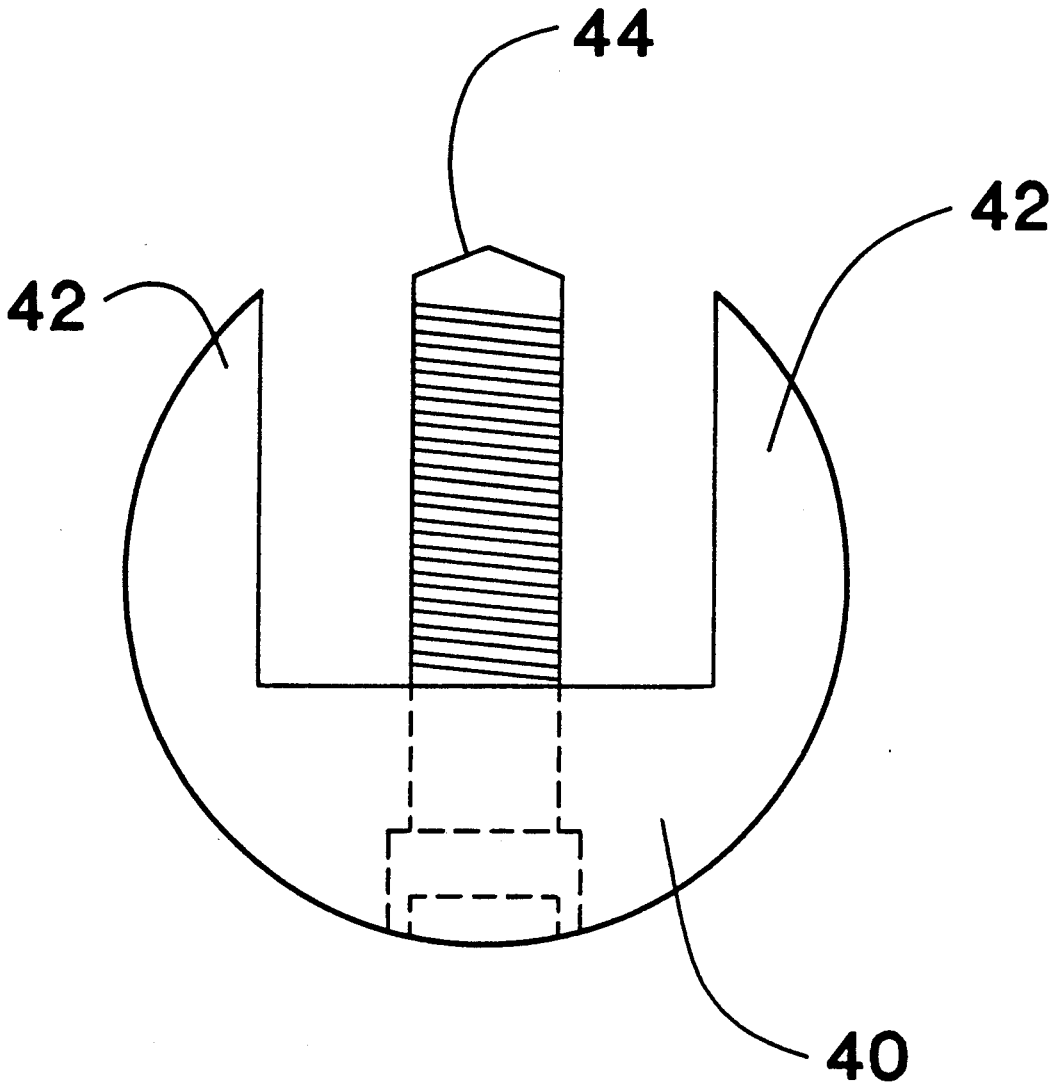
FIG. 5 is a plan view of a retaining means for use with the embodiment of FIG. 4.

The abrasive member is held in position in the slot 20 by an adjustable retaining means, in this case a holder 40 with arms 42 which extend into the slot 20. A plan view of the holder 40 is shown in FIG. 5. The holder conforms to the contour of the cylindrical member and occupies the position of the cylindrical member section of hemispherical cross section removed plus the slot area unoccupied by the abrasive member, producing a smooth outer surface for the cylindrical member. The holder 40 and sharpening stone 22 are retained in position by a socket head hex bolt 44 recessed into the holder 40 and inserted into a threaded aperture 46 which extends through the holder and into the main body of the cylindrical member be 10 at a point below the aperture bottom 18. A shaft 34 extends from the second end 14 of the cylindrical member, as described for FIG. 1, for connection to a rotary power source.

The sharpening procedure is performed as described earlier. Rotation or replacement of the sharpening stone 22 is achieved by removing the hex head bolt 44 and holder 40, providing easy access to the stone.

Figure 6:
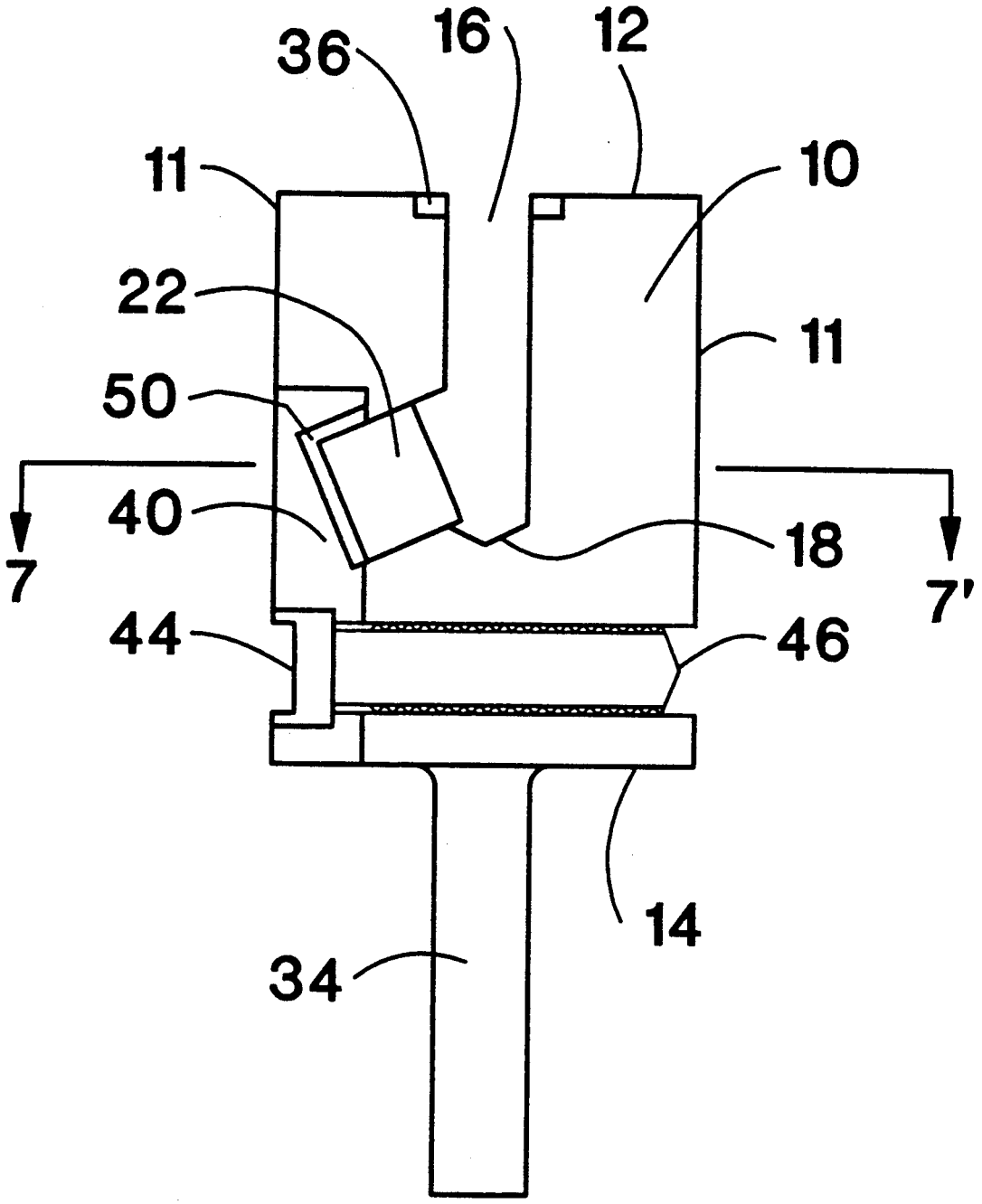
FIG. 6 is a vertical sectional view of yet another embodiment of the sharpening apparatus invention.

FIG. 6 shows another embodiment of the instant invention. Those components common to FIGS. 1, 4 and 6 are denoted by the same indica.

Referring to FIG. 6, the apparatus comprises a cylindrical member 10 with a cylindrical lateral surface 11, a first end 12 and a second end 14. Within the cylindrical member 10 is an aperture 16 which extends from the first end 12 toward the second end 14, but ends short of the second end, producing a closed end 18. The aperture has a selected diameter and is centered on the longitudinal axis of the cylindrical member 10.

Figure 7:
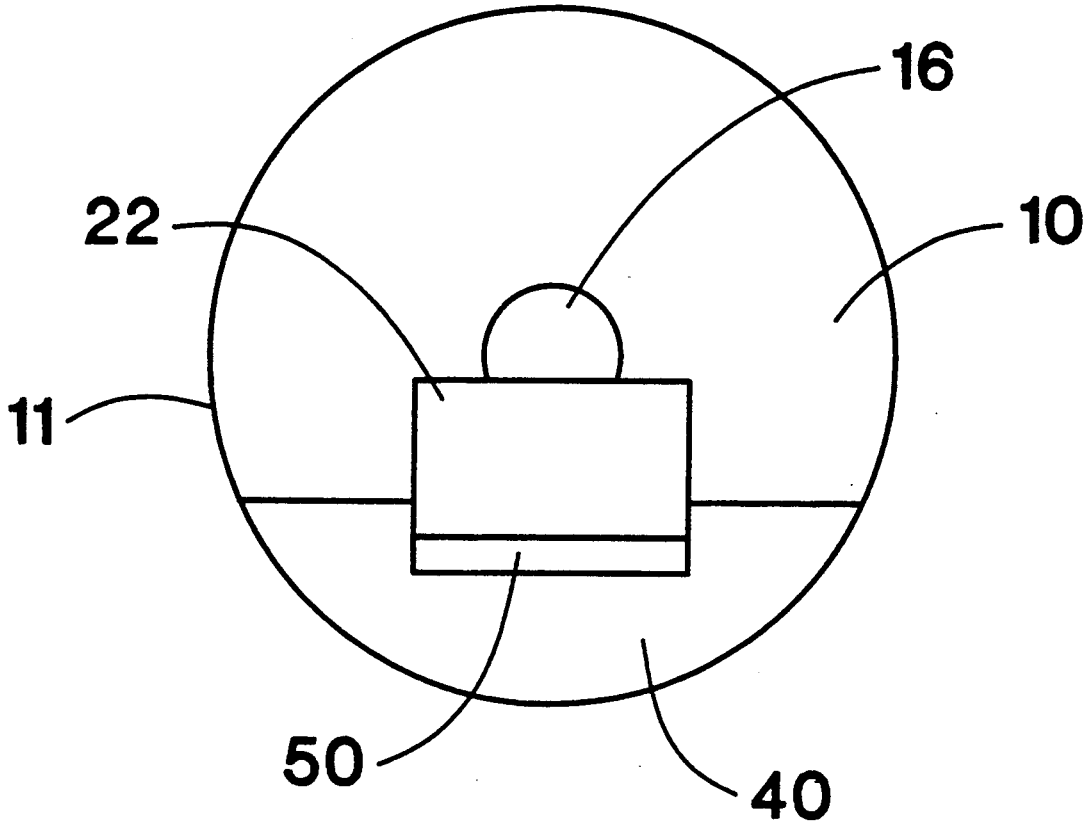
FIG. 7 is a horizontal sectional view along the line 7—7′ of FIG. 6.

The cylindrical member 10 be also contains a slot 20 which extends from the lateral surface 11 and intersects a part of the aperture near the closed end 18, at a selected angle to the aperture 16. The angle may be a right angle or an oblique angle as shown in FIG. 6. Near the outer edges of the cylindrical member, the slot extends only a portion of the distance to the intersection with the aperture. A cross sectional view of the device along the line 7—7' of FIG. 6 is shown in FIG. 7 which provides the orientation of the stone 22, the holder 40, the cushion 50 and the aperture 16. A generally rectangular abrasive member 22, such as a sharpening stone or similar material, fits into the slot and extends into the aperture 16 near the closed end 16. A hemispherical cross section portion of the cylindrical member 10 is removed, this portion extending from the second end 14 and intersecting the slot 20. The flat bottom of the portion is located about half way between the outer cylindrical lateral surface 11 and the longitudinal axis of the cylindrical member 10 as shown in FIG. 6.

The abrasive member is held in position in the slot 20 by an adjustable retaining means, in this case a holder 40 with a notch which conforms to the side of the stone 22 opposite the side extending into the aperture 16. A cushion material 50 is placed between the retaining means and the stone to prevent crushing of the stone when the retaining means is tightened. The holder 40 and sharpening stone 22 are retained in position by a socket head hex bolt 44 recessed into the holder 40 and inserted into a threaded aperture 46 which extends through the holder and into the main body of the cylindrical member 10 at a point below the aperture bottom 18. A shaft 34 extends from the second end 14 of the cylindrical member, as described for FIG. 1, for connection to a rotary power source. The bushing 36 at the top 12 of the cylindrical member 10 provides a guide for the object to be sharpened.

Optionally, the sharpening device shown In FIGS. 1, 4 or 6 may include a channel or aperture extending from the bottom of the aperture le to the exterior cylindrical lateral surface 11 of the cylindrical member to remove particles produced during the sharpening process.

The foregoing description of the preferred embodiments of the invention have been presented for purposes of illustration and description. It is not intended to be exhaustive or to limit the invention to the precise form disclosed and obviously many modifications and variations are possible in light of the above teaching. It is intended that the scope of the invention be defined by the claims appended hereto.

I claim:

1. An apparatus for sharpening pointed objects comprising:

a cylindrical member with first and second ends and cylindrical lateral surface, said cylindrical member containing a round aperture of selected diameter, centered on the longitudinal axis of said cylindrical member, said aperture extending from said first end and ending short of said second end, producing a closed end therein, said cylindrical member containing a slot extending from said cylindrical lateral surface and intersecting a portion of said aperture near said closed end at a selected angle;

an abrasive member positioned within said slot and extending into said aperture near said closed end;

adjustable retaining means for retaining said abrasive member in said slot and in contact with an end of a pointed object inserted within said aperture; and means extending from the second end of said cylindrical member along the longitudinal axis thereof, for attachment of a power source for rotating said apparatus.

2. An apparatus according to claim 1 wherein said angle of intersection between said slot and said aperture is oblique.

3. An apparatus according to claim 1 wherein said angle of intersection between said slot and said aperture is a right angle.

4. An apparatus according to claim 1 wherein said adjustable retaining means comprises a U-shaped holder, with first and second leg ends, fitting within said slot and contacting said abrasive member, a lever member with aperture therethrough and a retaining screw fitting through said lever member aperture and into a threaded aperture in said cylindrical member, whereby as the retaining screw advances into the threaded aperture, the lever member applies retaining force to said U-shaped holder and abrasive member within said slot.

5. An apparatus according to claim 4 wherein said first and second leg ends of said U-shaped holder are of unequal thickness, providing an offset positioning of said abrasive member within said slot in said aperture.

6. An apparatus according to claim 1 further comprising a bushing positioned circumferentially in said aperture at said first end of said cylindrical member to contact an object to be sharpened and prevent ware to the cylindrical member.

7. An apparatus according to claim 1 wherein said abrasive member is a sharpening stone.

8. An apparatus according to claim 1 wherein said sharpening stone is composed of aluminum oxide, silicon carbide or diamond embedded material.

9. An apparatus for sharpening pointed objects comprising:

a cylindrical member with first and second ends and cylindrical lateral surface, said cylindrical member containing a round aperture of selected diameter, centered on the longitudinal axis of said cylindrical member, said aperture extending from said first end and ending short of said second end, producing a closed end therein, said cylindrical member containing an slot extending from said cylindrical lateral surface and intersecting a portion of said aperture near said closed end at a selected angle, said cylindrical member further modified by removing a section of hemispherical cross section from said cylindrical member, said section extending from said second end of said member up to and intersecting said slot;

an abrasive member positioned within said slot and extending into said aperture near said closed end;

adjustable retaining means for retaining said abrasive member in said slot and in contact with an end of a pointed object inserted within said aperture; and means extending from the second end of said cylindrical member along the longitudinal axis thereof, for attachment of a power source for rotating said apparatus.

10. An apparatus according to claim 9 wherein said adjustable retaining means comprises a holder cylindrical section with a pair of arms and an aperture therethrough, said holder conforming to the cylindrical member section of hemispherical cross section removed and the slot area unoccupied by said abrasive member, and a threaded bolt fitting through said holder aperture and into a threaded aperture in said cylindrical member, whereby as the retaining bolt advances into the threaded aperture, the holder member applies retaining force to said abrasive member within said slot.

11. An apparatus according to claim 9 further comprising a cushion positioned between said abrasive member and said retaining means to protect said abrasive member from damage by said adjustable retaining means.

12. An apparatus according to claim 9 further comprising a bushing positioned circumferentially in said aperture at said first end of said cylindrical member to contact an object to be sharpened and prevent ware to the cylindrical member.

13. An apparatus according to claim 9 further comprising a channel extending from said closed end of said aperture to a point on the exterior of said cylindrical member to remove particles produced in the sharpening of the pointed object.

14. An apparatus according to claim 9 wherein said abrasive member is a sharpening stone.

15. An apparatus according to claim 9 wherein said sharpening stone is composed of aluminum oxide, silicon carbide or diamond embedded material.

* * * * *